United States Patent [19]

Fattal

[11] Patent Number: 4,923,316

[45] Date of Patent: May 8, 1990

[54] GOLF CLUB CLEANING DEVICE

[76] Inventor: Gregory M. Fattal, 11310 Burlington, #457, Southgate, Mich. 48195

[21] Appl. No.: 320,612

[22] Filed: Mar. 8, 1989

[51] Int. Cl.[5] ..... A46B 15/00; A46B 11/00

[52] U.S. Cl. ..... 401/11; 15/107; 15/210 B; 273/32 B; 51/392; 401/138

[58] Field of Search ..... 51/391, 392, 393, 407, 51/406, 205 R; 273/81 R, 32 B, 32 R, 32.5, 73 R, 75; 15/104.92, 104.93, 104.94, 107, 210 B; 401/4, 9, 11, 292, 268, 138

[56] References Cited

U.S. PATENT DOCUMENTS

| | | | |
|---|---|---|---|
| 1,595,700 | 8/1926 | Backlind | 51/391 |
| 1,714,346 | 5/1929 | Carleton | 15/210 B |
| 1,759,739 | 5/1930 | Ferris | 51/392 |
| 1,927,574 | 9/1933 | Parks | 51/392 X |
| 2,420,397 | 5/1947 | Jensen | 51/393 |
| 2,644,280 | 7/1953 | O'Neil | 51/406 |
| 2,760,217 | 8/1956 | McKenzie | 51/393 X |
| 4,284,275 | 8/1981 | Fletcher | 273/72 R |
| 4,464,072 | 8/1984 | Norwell | 273/32 B |

*Primary Examiner*—Richard J. Johnson

*Attorney, Agent, or Firm*—Jerry T. Kearns

[57] ABSTRACT

A golf club cleaning device includes an elongated generally rectangular base having a first face provided with a concave recess lined with a sponge rubber material having an outer emery cloth layer. The recess is dimensioned to partially surround the grip of a golf club for abrading the golf club grip material to provide an enhanced grip surface. A plurality of bristles form a cleaning brush on an opposite face of the base. In a second embodiment, a stiff wire cleaning brush is formed on an end face of the base and an elongated groove extends down a side face of the base and is lined with a soft fabric material for polishing and cleaning golf club shafts. The base may include a receptacle for storing a quantity of cleaning or polishing fluid.

3 Claims, 3 Drawing Sheets

GOLF CLUB CLEANING DEVICE

BACKGROUND OF THE INVENTION

1. Field of the Invention

The present invention relates to golf club cleaning devices, and more particularly pertains to a new and improved golf club cleaning device provided with a concave recess dimensioned to surround a golf club grip and lined with an abrasive material in order to abrade and renew the golf grip surface. Conventional golf clubs utilize rubber or synthetic materials to form the grip portion of the golf club. In new condition, these grips have a roughened outer surface to provide an enhanced frictional gripping engagement with the golfer's hands to avoid twisting of the club during the golfer's swing. Over time, the golf grips become worn down and slick due to constant usage and to exposure to perspiration from the golfer's hands. When the golf grip becomes slick, the golfer's swing suffers because of the insecure gripping surface. Conventionally, golfers are forced to have their clubs regripped at a golf pro shop in order to solve this problem. In order to alleviate this inconvenience and expense, the present invention provides a device for abrading and restoring the roughened outer grip surface and also provides additional cleaning facilities for general golf club maintenance.

2. Description of the Prior Art

Various types of golf club cleaning devices are known in the prior art. A typical example of such a golf club cleaning device is to be found in U.S. Pat. No. 4,464,072, which issued to J. Norwell on Aug. 7, 1984. This patent discloses a liquid container having a sprayer and includes a brush for golf club cleaning. A retaining clip is utilized to secure the device to a golf bag during play.

While the above mentioned device is directed to a golf club cleaning device, this device does not disclose an implement for restoring the gripping surface of a golf club. Additional features of the present invention, not contemplated by the prior art devices, include the provision of a concave recess having a sponge rubber lining covered by an emery cloth layer for conformance to a golf club grip to allow abrasive renewal of the frictional gripping surface, an elongated groove lined with a soft fabric material for cleaning and polishing a golf club shaft and a stiff wire brush for cleaning golf club heads, along with the provision of a cleaning fluid receptacle in an integrated golf club cleaning device. Inasmuch as the art is relatively crowded with respect to these various types of golf club cleaning devices, it can be appreciated that there is a continuing need for and interest in improvements to such golf club cleaning devices, and in this respect, the present invention addresses this need and interest.

SUMMARY OF THE INVENTION

In view of the foregoing disadvantages inherent in the known types of golf club cleaning devices now present in the prior art, the present invention provides an improved golf club cleaning device. As such, the general purpose of the present invention, which will be described subsequently in greater detail, is to provide a new and improved golf club cleaning device which has all the advantages of the prior art golf club cleaning devices and none of the disadvantages.

To attain this, representative embodiments of the concepts of the present invention are illustrated in the drawings and make use of a golf club cleaning device which includes an elongated generally rectangular base having a first face provided with a concave recess lined with a sponge rubber material having an outer emery cloth layer. The recess is dimensioned to partially surround the grip of a golf club for abrading the golf club grip material to provide an enhanced grip surface. A plurality of bristles form a cleaning brush on an opposite face of the base. In a second embodiment, a stiff wire cleaning brush is formed on an end face of the base and an elongated groove extends down a side face of the base and is lined with a soft fabric material for polishing and cleaning golf club shafts. The base may include a receptacle for storing a quantity of cleaning or polishing fluid.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readilY be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursorY inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf club cleaning device which has all the advantages of the prior art golf club cleaning devices and none of the disadvantages.

It is another object of the present invention to provide a new and improved golf club cleaning device which may be easily and efficiently manufactured and marketed.

It is a further object of the present invention to provide a new and improved golf club cleaning device which is of a durable and reliable construction.

An even further object of the present invention is to provide a new and improved golf club cleaning device which is susceptible of a low cost of manufacture with regard to both materials and labor, and which accordingly is then susceptible of low prices of sale to the consuming public, thereby making such golf club cleaning devices economically available to the buying public.

Still yet another object of the present invention is to provide a new and improved golf club cleaning device which provides in the apparatuses and methods of the prior art some of the advantages thereof, while simultaneously overcoming some of the disadvantages normally associated therewith.

Still another object of the present invention is to provide a new and improved golf club cleaning device which includes an abrasive lined concave recess for renewing the gripping surface of a golf club.

Yet another object of the present invention is to provide a new and improved golf club cleaning device which includes a base having a concave recess lined with a sponge rubber material and having an emery cloth coating which allows the emery cloth layer to deform for close conformance to the gripping surface of a golf club.

Even still another object of the present invention is to provide a new and improved golf club cleaning device which includes a golf grip abrasive renewing tool, a cleaning brush, a wire club head cleaning brush, a shaft cleaning and polishing tool, and a cleaning fluid receptacle in an integrated easily portable device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
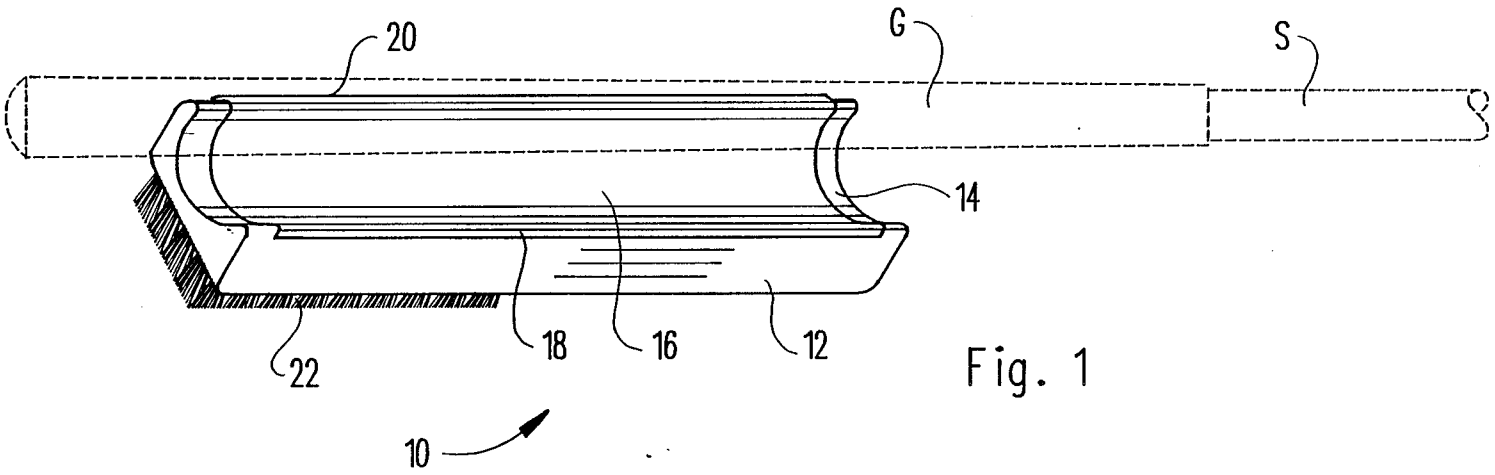
FIG. 1 is a perspective view of the cleaning device according to a first embodiment of the present invention illustrated in use on a conventional golf club gripping surface.

With reference now to the drawings, and in particular to FIG. 1 thereof, a new and improved golf club cleaning device embodying the principles and concepts of the present invention and generally designated by the reference numeral 10 will be described.

More specifically, it will be noted that the first embodiment 10 of the invention includes a generally rectangular elongated base 12. A concave recess 14 extends along a top face of the base 12 and is dimensioned to partially surround a conventional golf club grip G mounted on the end of a golf club shaft S. A layer of emery cloth 16 lines the concave recess 14 for engagement with the grip G. The preferred dimensions of the rectangular base 12 are a length of between three and six inches, a width of about one and one-half inches and a three quarter inch thickness. The emery cloth is preferably one hundred grit which is satisfactory to slightly roughen the outer surface of the material forming the golf club grip G. It should be noted that the conventional golf club grips are formed of synthetic or leather materials. By applying the abrasive emery layer 16 along and around the grip G, the slick outer surface will be roughened, providing a restored friction enhancing gripping surface which will result in a better golfing swing. Opposite parallel side edges 18 and 20 of the emery cloth material 16 partially overlap the side edges of the base 12. The emery cloth layer 16 may be of the type having an adhesive backing covered by a removable peel-off strip. This enables the emery cloth layer 16 to be replaced as required. Alternatively, the entire unit may be formed of an extremely inexpensive construction and disposed after prolonged use. A plurality of bristles may optionally be provided on a bottom face of the base 12, opposite the recess 14. The bristles 22 are preferably formed from a stiff natural or synthetic material and may be used for general cleaning of the golf club and also of a golfer's shoes. Alternatively, the bristles 22 may be formed from a wire material for cleaning a golfer's spikes and for cleaning the club head portion of the golf club.

Figure 2:
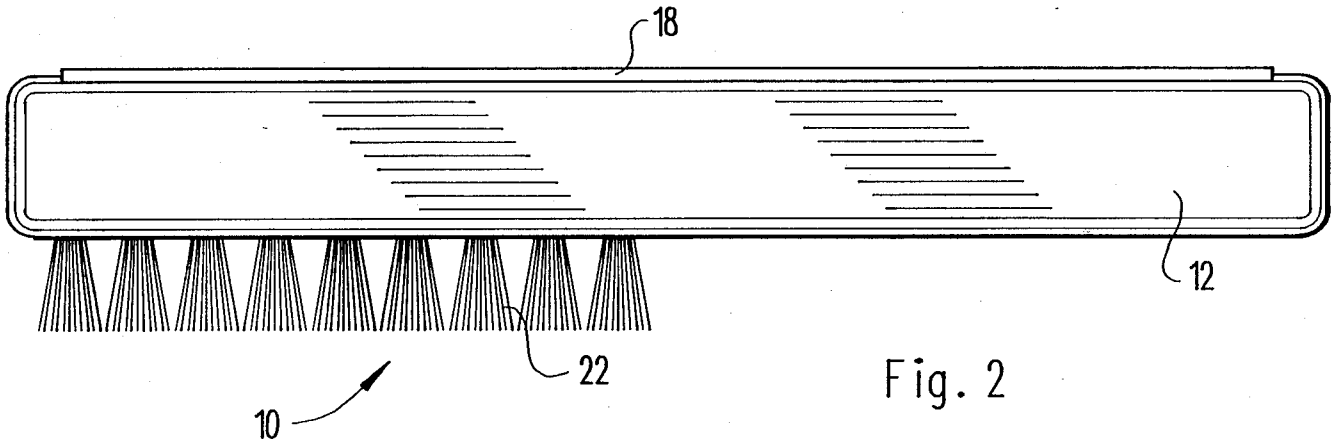
FIG. 2 is a side view of the golf club cleaning device of FIG. 1.

FIG. 2 illustrates a side view of the golf club cleaning device according to the first embodiment 10.

Figure 3:
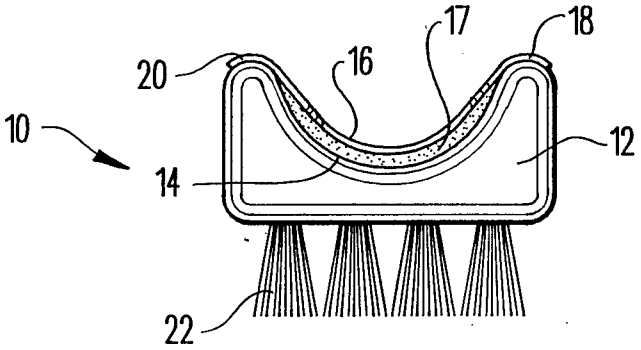
FIG. 3 is an end view of the golf club cleaning device of FIG. 1.

FIG. 3 is an end view of the golf club cleaning device 10 which illustrates a layer of resilient material 17 lining the concave recess 14, between the base 12 and the emery cloth layer 16. The resilient material 17 is preferably a foam rubber layer about ⅛ of an inch in thickness which is adhesively secured within the recess 14. The resilient sponge rubber layer 17 allows the emery cloth 16 to conform to the irregular grip surface which enhances the abrasive restoration process. In use, the base 12 is reciprocated along the length of the grip and along both opposite sides of the grip.

Figure 4:
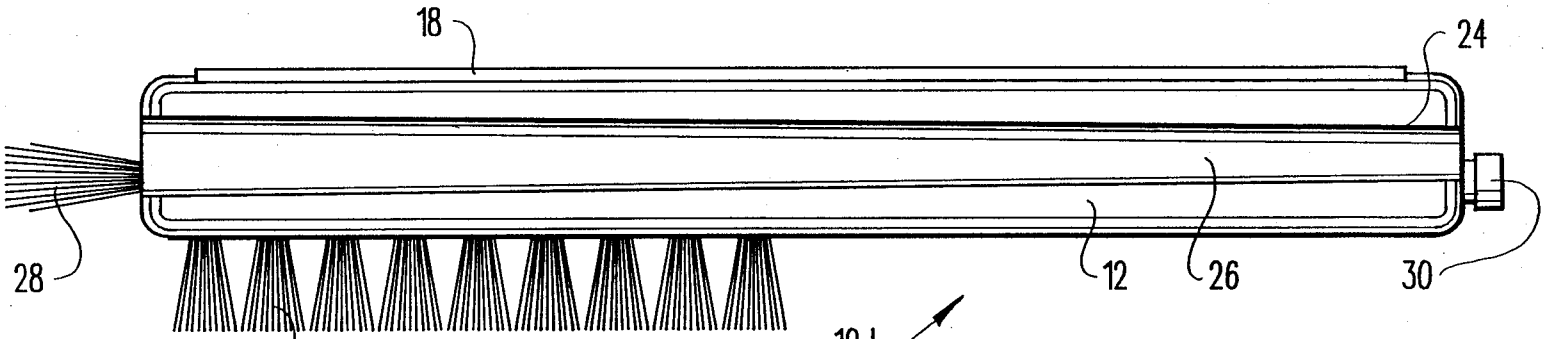
FIG. 4 is a side view illustrating a golf club cleaning device according to a second embodiment of the present invention.

FIG. 4 illustrates a golf club cleaning device 10' according to a slightly modified embodiment of the present invention which is constructed as described previously, with the following additional features. An elongated groove 24 is formed in a side wall of the base 12 and is lined with a soft fabric material 26. The groove 24 is preferably dimensioned to partially surround the shaft of a golf club for cleaning and polishing the shaft. The groove 24 may taper in diameter from one end of the base 12 to the other, for use on tapering golf club shafts. The base 12 may be formed with a hollow interior which communicates with a removable end cap 30 for storing a supply of cleaning or polishing fluid. An additional brush 28 may be formed on an opposite end face of the base 12, preferably from a stiff wire material for cleaning golf club heads and golf shoes spikes. The bristles 22 would then be formed from a softer material for general cleaning purposes.

Figure 5:
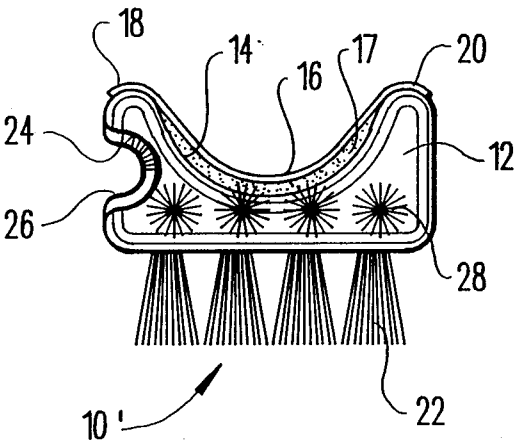
FIG. 5 is a front end view of the golf club cleaning device of FIG. 4.

FIG. 5 is an end view of the cleaning device 10' illustrating the brush portion 28.

Figure 6:
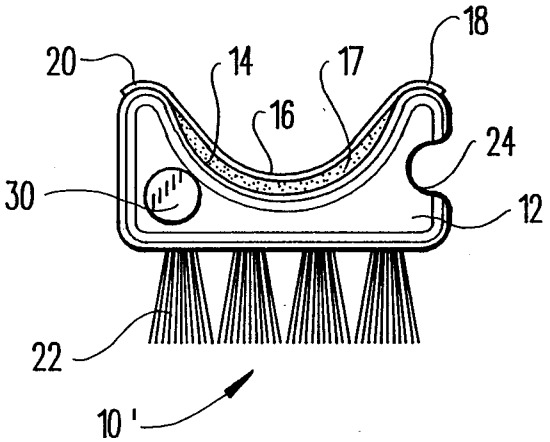
FIG. 6 is a back end view of the golf club cleaning device of FIG. 4.

FIG. 6 is an opposite end view of the golf club cleaning device 10' illustrating the cleaning fluid receptacle cap 30.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United State is as follows:

1. A golf club cleaning device, comprising:
an elongated generally rectangular base;
a concave recess extending along one face of said base, said recess dimensioned to partially surround a golf club grip;
a layer of sponge rubber lining said recess;
a layer of emery cloth secured to said sponge rubber;
a plurality of bristles extending along an opposite face of said base, forming a cleaning brush;
an elongated groove dimensioned to partially surround a golf club shaft extending along a side wall of said base, a soft fabric material lining said groove;
a cleaning fluid receptacle formed in said base; and
a stiff wire brush formed on an end face of said base.

2. A golf club cleaning device, comprising:
an elongated generally rectangular base;
a concave recess extending along one face of said base, said recess dimensioned to partially surround a golf club grip;
a layer of sponge rubber lining said recess;
a layer of emery cloth secured to said sponge rubber;
a plurality of bristles extending along an opposite face of said base, forming a cleaning brush;
an elongated groove dimensioned to partially surround a golf club shaft extending along a side wall of said base, a soft fabric material lining said groove; and
a stiff wire brush formed on an end face of said base.

3. A golf club cleaning device, comprising:
an elongated generally rectangular base;
a concave recess extending along one face of said base, said recess dimensioned to partially surround a golf club grip;
a layer of sponge rubber lining said recess;
a layer of emery cloth secured to said sponge rubber;
a plurality of bristles extending along an opposite face of said base, forming a cleaning brush; and
an elongated groove dimensioned to partially surround a golf shaft extending along a side wall of said base, a soft fabric material lining said groove.

* * * * *